US005783906A

United States Patent [19]

Moore et al.

[11] Patent Number: 5,783,906

[45] Date of Patent: Jul. 21, 1998

[54] SPUTTER-RESISTANT, LOW-WORK-FUNCTION, CONDUCTIVE COATINGS FOR CATHODE ELECTRODES IN DC PLASMA ADDRESSING STRUCTURE

[75] Inventors: John S. Moore; William W. Stein, both of Beaverton; Donald E. Kephart, Portland, all of Oreg.

[73] Assignee: Tektronix, Inc., Wilsonville, Oreg.

[21] Appl. No.: 870,763

[22] Filed: Jun. 6, 1997

Related U.S. Application Data

[63] Continuation of Ser. No. 520,996, Aug. 30, 1995, abandoned.

[51] Int. Cl.[6] ..... H01J 17/49

[52] U.S. Cl. ..... 313/586; 345/60; 445/50; 445/58; 313/584

[58] Field of Search ..... 445/50, 51, 58; 345/60; 313/582, 584, 586, 587

[56] References Cited

U.S. PATENT DOCUMENTS

| | | | |
|---|---|---|---|
| 4,176,297 | 11/1979 | Thistle et al. | 345/65 |
| 4,896,149 | 1/1990 | Buzak et al. | 345/60 |
| 5,077,553 | 12/1991 | Buzak | 345/60 |
| 5,440,201 | 8/1995 | Martin et al. | 345/60 X |
| 5,449,970 | 9/1995 | Kumar et al. | 345/75 X |
| 5,453,660 | 9/1995 | Martin et al. | 345/60 X |
| 5,461,395 | 10/1995 | Stein | 345/60 |
| 5,483,263 | 1/1996 | Bird et al. | 345/104 X |
| 5,523,770 | 6/1996 | Tanamachi | 345/60 |
| 5,534,744 | 7/1996 | Lerox et al. | 345/74 X |
| 5,561,443 | 10/1996 | Disanto et al. | 345/60 X |
| 5,684,361 | 11/1997 | Seki | 313/582 |

*Primary Examiner*—Kenneth J. Ramsey

*Attorney, Agent, or Firm*—John D. Winkelman; Paul S. Angello

[57] ABSTRACT

A refractory compound coating (188) for electrodes is sputter resistant, has a low work function so that it is a good emitter of secondary electrons, is very resistant to oxidation, and is easy to apply by way of electrophoresis. More specifically, cathode electrodes (162) are used in a plasma addressing structure (10). The coating is preferably formed by electrophoretic deposition of particles (184) of at least one refractory compound along with a frit. The coating is subsequently baked to fuse the frit and bond the electrophoretically deposited particles to the electrodes.

16 Claims, 4 Drawing Sheets

SPUTTER-RESISTANT, LOW-WORK-FUNCTION, CONDUCTIVE COATINGS FOR CATHODE ELECTRODES IN DC PLASMA ADDRESSING STRUCTURE

This is a continuation of application No. 08/520,996 filed on Aug. 30, 1995, now abandoned.

TECHNICAL FIELD

The invention relates to the formation of electrodes with specific properties and, more particularly, to the formation of sputter resistant cathode electrodes for a DC plasma addressing structure.

BACKGROUND OF THE INVENTION

Systems employing data storage elements include, for example, video cameras and image displays. Such systems employ an addressing structure that provides data to or retrieves data from the storage elements. One system of this type to which one embodiment of the present invention is particularly directed is a general purpose flat panel display whose storage or display elements store light pattern data. Flat panel-based display systems present a desirable alternative to the comparatively heavy, bulky and high-voltage cathode-ray tube-based systems.

A flat panel display comprises multiple display elements or "pixels" distributed throughout the viewing area of a display surface. In a liquid crystal flat panel display the optical behavior of each pixel is determined by the magnitude of the electrical potential gradient applied across it. It is generally desirable in such a device to be able to set the potential gradient across each pixel independently. Various schemes have been devised for achieving this end. In currently available active matrix liquid crystal arrays there is, generally, a thin film transistor for every pixel. This transistor is typically strobed "on" by a row driver line at which point it will receive a value from a column driver line. This value is stored until the next row driver line strobe. Transparent electrodes on either side of the pixel apply a potential gradient corresponding to the stored value across the pixel, determining its optical behavior.

U.S. Pat. No. 4,896,149 describes the construction and operation of an alternative type of active matrix liquid crystal array, named a "plasma addressable liquid crystal" or "PALC" display. This technology avoids the cumbersome and restrictive use of a thin film transistor for every pixel. Each pixel of the liquid crystal cell is positioned between a thin, impermeable dielectric barrier and a conductive surface. On the opposed side of the thin barrier an inert gas is stored which may be selectively switched from a nonionized, nonconductive state to an ionized conductive plasma through the application of a sufficient electrical potential gradient across the gas volume.

When the gas is in a conductive state, it effectively sets the surface of the thin barrier to ground potential. In this state, the electrical potential across the pixel and thin dielectric barrier is equal to whatever voltage appears on the conductive surface. After the voltage across the gas volume is removed, the ionizable gas reverts to a nonconductive state. The potential gradient introduced across the pixel is stored by the natural capacitances of the liquid crystal material and the dielectric barrier. This potential gradient remains constant regardless of the voltage level of the conductive surface because the thin barrier voltage will float at a level below that of the conductive surface by the difference that was introduced while it was grounded.

Viewed on a larger scale, a PALC display includes a set of channels formed in an insulating plate and containing inert gas under a top plate that contacts the tops of the ribs forming the channel and is sealingly connected around the periphery with the insulating plate. Parallel electrodes extend along the length of each channel at opposed sides. During operation, the gas is ionized and thereby rendered a conductive plasma by the introduction of a large potential gradient between opposed electrodes. This operation occurs many times per second while the display is in operation.

To avoid differences in electrical potential along the length of the electrodes during the ionization of the gas, it is desirable that the resistance per unit length of the electrodes be no more than 2 ohms per centimeter (5 ohms per inch). To achieve this small value of resistance per unit length with the tiny cross sectional area that is available for the electrodes, highly conductive metals such as gold, silver, copper, or aluminum are used.

Because they are costly, gold and silver are undesirable although they oxidize minimally in the one hour bake in standard atmosphere that is part of the PALC display fabrication process. Copper oxidizes considerably in this bake and loses conductivity. Aluminum, unfortunately, is less electrically conductive than would be ideal. Copper that is plated with an oxidation resistent metal provides an electrode of uniformly low resistance per unit length that is sufficiently resistant to oxidation.

Chromium has been tested as a metal to plate onto copper and has been found to perform quite well for oxidation resistance. Unfortunately, however, this configuration leads to "sputter damage." Sputter damage is literally the atom-by-atom sublimation of the cathode surface and occurs when positive ions of inert gas collide with the surface of the cathode. If the cathode surface material is susceptible to sputtering, the cathode eventually becomes thinner and more resistive, and the cathode material that is sputtered away deposits on the light transmitting portions of the channels, eventually darkening the display.

The use of a chromium plating leads to sputter damage in two ways. First, chromium has a high work function and, therefore, is not a good emitter of secondary electrons. Because these electrons must be emitted in sufficient quantity to render the inert gas into a conductive plasma, the voltage difference between cathode and anode must be greatly increased. As a result, the gas ions will be accelerated by this greater voltage gradient and therefore will attain a higher kinetic energy by the time they collide with the cathode surface, thereby leading to more rapid sputter damage.

Second, chromium has a comparatively low heat of sublimation. This directly translates to a comparatively high susceptibility to sputter damage. As a result, when a chromium coating constitutes the exterior layer on the cathode, the display lasts for only about 500 hours before the result of the sputter damage becomes so severe that the display is no longer usable. To be commercially acceptable, a product should typically have an operational lifetime of at least 10,000 working hours and preferably more than 20,000.

Not only must the exterior coating on the cathode be a good emitter of secondary electrons and resistant to sputter damage, it must also not be susceptible to oxidation during the one hour air bake that is an integral part of the PALC display production process. Good secondary electron emitters have low work functions, and materials with good sputter resistance have a high heat of sublimation.

Finally, any arrangement of materials used to form a cathode sufficient to solve the problems described above would be impracticable unless an economical process is available for realizing the arrangement.

SUMMARY OF THE INVENTION

An object of the present invention is, therefore, to provide a cathode electrode that is resistant to oxidation and sputter damage and is a good emitter of secondary electrons. Another object of the present invention is to provide such cathode electrodes in a PALC display.

The present invention is a coating for a cathode electrode comprising at least one refractory compound and is a process for coating the cathode electrode by way of electrophoretic deposition of particles of at least one refractory compound. In the present invention a second class of particles, known as a "frit", is also deposited. In the subsequent one hour air bake, these particles melt and thereby cement the refractory compound particles to the electrode surfaces.

The present invention is also a plasma addressing structure in which particles of at least one refractory compound are deposited on the cathodes of the display by means of electrophoretic deposition.

Additional objects and advantages of this invention will be apparent from the following detailed description of a preferred embodiment thereof which proceeds with reference to the accompanying drawings.

DETAILED DESCRIPTION OF A PREFERRED EMBODIMENT

Figure 1:
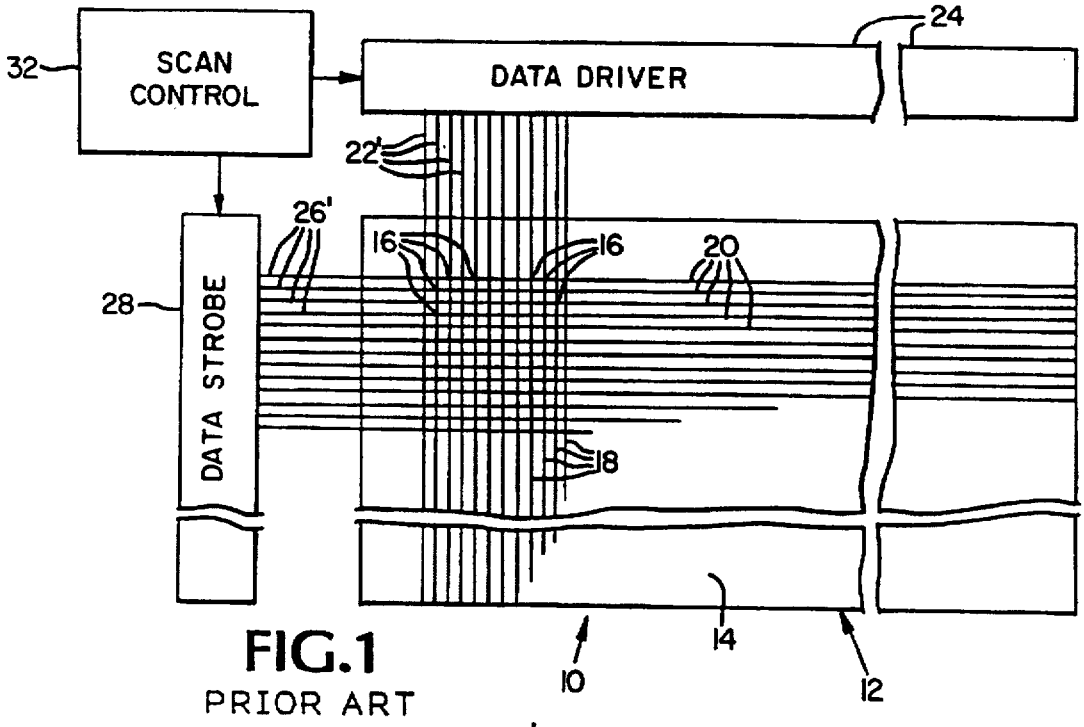
FIG.1 PRIOR ART
FIG. 1 is a diagram showing a frontal view of the display surface of a prior art display panel and associated drive circuitry of a plasma addressing structure in which the present invention could be employed.
Figure 3:
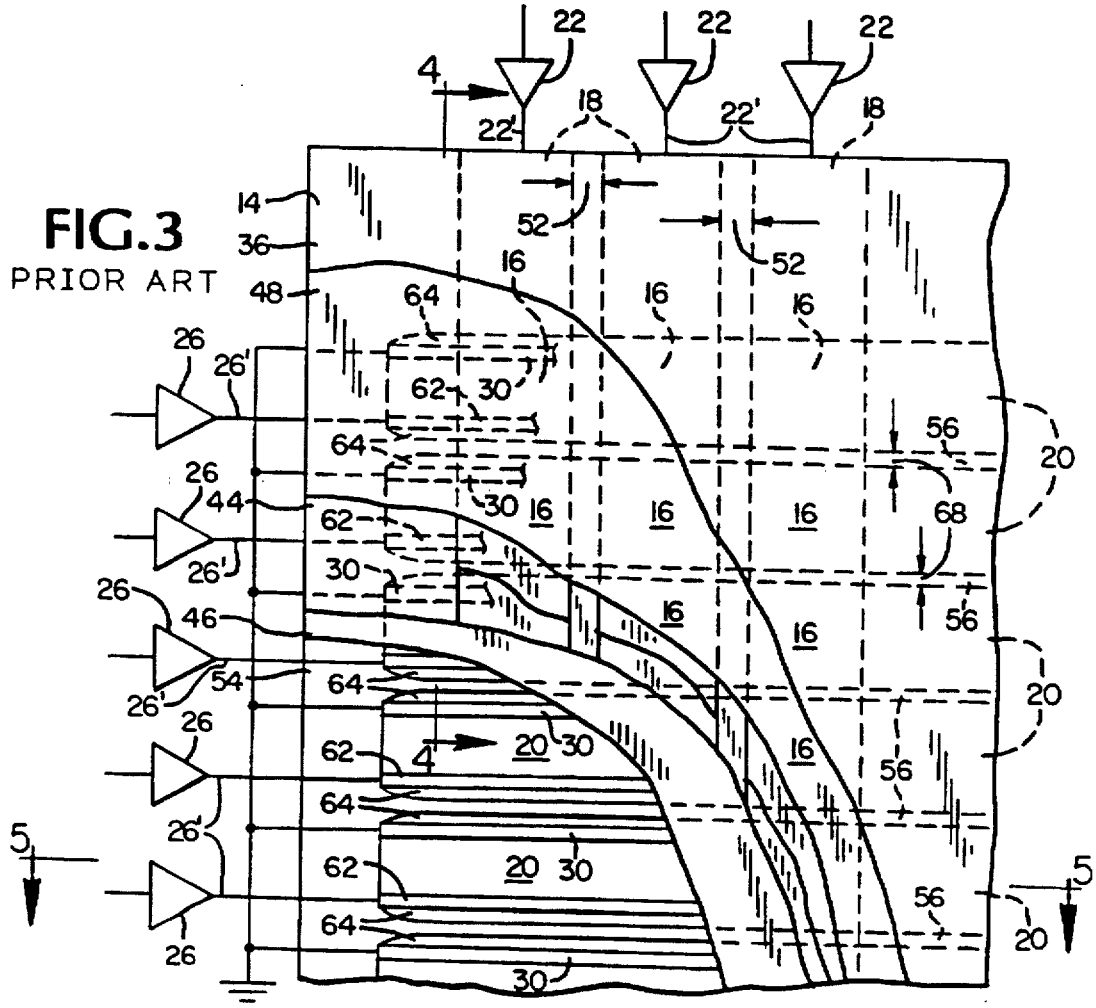
FIG.3 PRIOR ART
FIG. 3 is an enlarged fragmentary frontal view with portions broken away to show different depthwise views of the interior of the prior art display panel of FIG. 2.
Figure 2:
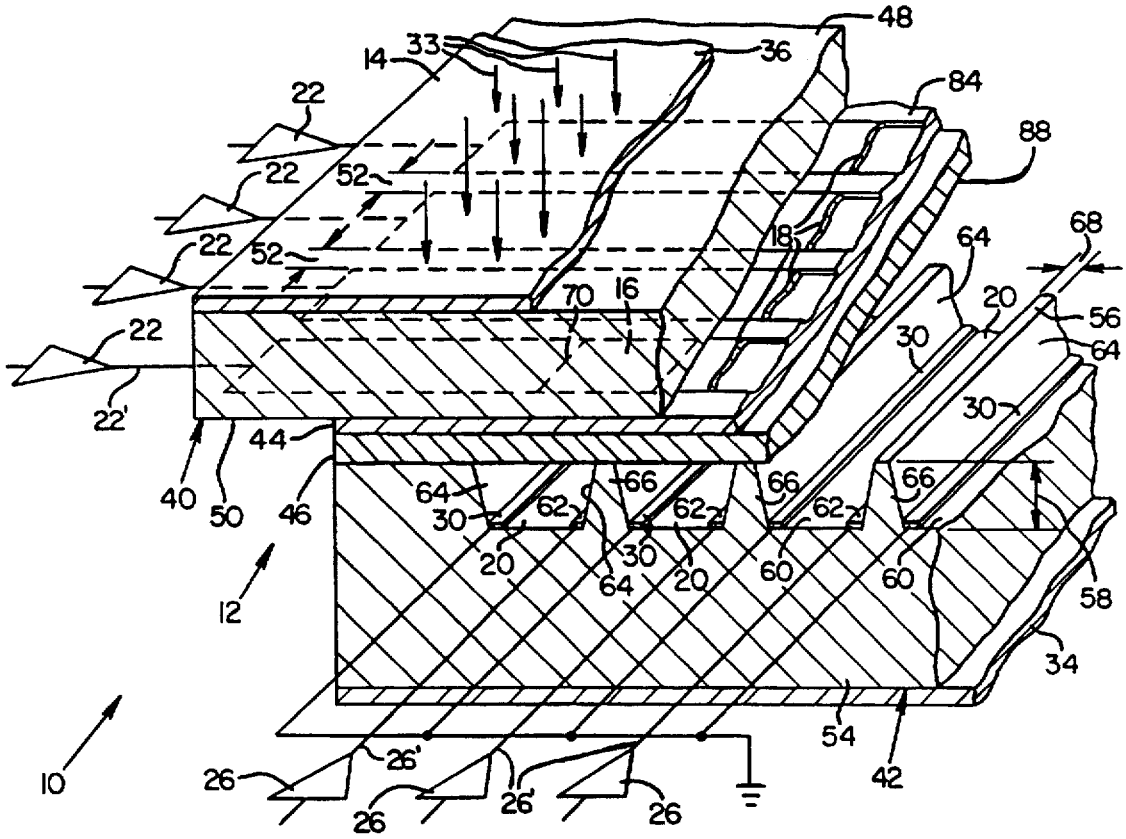
FIG.2 PRIOR ART
FIG. 2 is an enlarged fragmentary isometric view showing the layers of structural components forming the prior art display panel as viewed from the left side in FIG. 1.

FIGS. 1–3 show a flat panel display system 10, which implements a prior art plasma addressing structure that includes a set of elongated cathodes 62 with respect to which the present invention may be implemented. With reference to FIGS. 1–3, flat panel display system 10 comprises a display panel 12 having a display surface 14 that contains a pattern formed by a rectangular planar array of nominally identical data storage or display elements ("pixels") 16 mutually spaced apart by predetermined distances in the vertical and horizontal directions. Each display element or pixel 16 in the array represents the overlapping intersection of a thin, narrow vertically-oriented electrode 18 and an elongated, narrow horizontally-oriented plasma channel 20. (The electrodes 18 are hereinafter referred to as "column electrodes 18.") All of the display elements or pixels 16 of a particular plasma channel 20 are set simultaneously when the inert gas in the plasma channel is sufficiently ionized. Each pixel is set to the potential gradient between the column electrode and ground at this time.

The widths of column electrodes 18 and plasma channels 20 determine the dimensions of display elements 16, which are of rectangular shape. Column electrodes 18 are deposited on a major surface of a first electrically nonconductive, optically transparent substrate, and plasma channels 20 are inscribed in a major surface of a second electrically nonconductive, optically transparent substrate. Skilled persons will appreciate that certain systems, such as a reflective display of either the direct view or projection type, would require that only one of the substrates be optically transparent.

Column electrodes 18 receive data drive signals of the analog voltage type developed on parallel output conductors 22' by different ones of the output amplifiers 22 (FIGS. 2 and 3) of a data driver or drive circuit 24, and plasma channels 20 receive data strobe signals of the voltage pulse type developed on output conductors 26' by different ones of the output amplifiers 26 (FIGS. 2 and 3) from the output of strobe circuit 28. Each of the plasma channels 20 includes a reference electrode 30 (FIGS. 2 and 3) to which a reference potential common to each channel 20 and data strobe 28 is applied.

To synthesize an image on the entire area of display surface 14, display system 10 employs a scan control circuit 32 that coordinates the functions of data driver 24 and data strobe 28 so that all columns of display elements 16 of display panel 12 are addressed row by row in row scan fashion. Display panel 12 may employ electro-optic materials of different types. For example, if it uses such a material that changes the polarization state of incident light rays 33 (FIG. 3), display panel 12 is positioned between a pair of light polarizing filters 34 and 36 (FIG. 2), which cooperate with display panel 12 to change the luminance of light propagating through them. The use of a scattering liquid crystal cell as the electro-optic material would not require the use of polarizing filters 34 and 36, however. A color filter (not shown) may be positioned within display panel 12 to develop multi-colored images of controllable color intensity. For a projection display, color can also be achieved by using three separate monochrome panels 10, each of which controls one primary color.

With particular reference to FIGS. 2 and 3, display panel 12 comprises an addressing structure that includes a pair of generally parallel electrode structures 40 and 42 spaced apart by a layer 44 of electro-optic material, such as a nematic liquid crystal, and a thin layer 46 of a dielectric material, such as glass, mica, or plastic. Electrode structure 40 comprises a glass dielectric substrate 48 that has deposited on its inner surface 50 column electrodes 18 of indium tin oxide, which is optically transparent, to form a striped pattern. Adjacent pairs of column electrodes 18 are spaced apart a distance 52, which defines the horizontal space between next adjacent display elements 16 in a row.

Electrode structure 42 comprises a glass dielectric substrate 54 into whose top surface 56 multiple plasma channels 20 of trapezoidal cross section with rounded side walls are inscribed. Plasma channels 20 have a depth 58 measured from top surface 56 to a base portion 60. Each one of the plasma channels 20 has an anode electrode 30 and cathode electrode 62, both of which are thin and narrow. Each of these electrodes extend along base portion 60 and one out of a pair of inner side walls 64 which diverge in the direction away from base portion 60 toward inner surface 56.

The anode electrodes 30 of the plasma channels 20 are connected to a common electrical reference potential, which can be fixed at ground potential as shown. The cathode electrodes 62 of the plasma channels 20 are connected to different ones of the output amplifiers 26 (of which three and five are shown in FIG. 2 and FIG. 3, respectively) of data strobe 28. To ensure proper operation of the addressing structure, the anode electrodes 30 and cathode electrodes 62 preferably are connected to the electrical reference potentials and the amplified outputs 26' of data strobe 28, respectively, on opposite edges of display panel 10.

The sidewalls 64 between adjacent plasma channels 20 define a plurality of support structures 66 whose top surfaces 56 support layer 46 of dielectric material. Adjacent plasma channels 20 are spaced apart by the width 68 of the top portion of each support structure 66, which width 68 defines the vertical space between next adjacent display elements 16 in a column. The overlapping regions 70 of column electrodes 18 and plasma channels 20 define the dimensions of display elements 16, which are shown in dashed lines in FIGS. 2 and 3. FIG. 3 shows with better clarity the array of display elements 16 and the vertical and horizontal spacings between them.

The magnitude of the voltage applied to column electrodes 18 specifies the distance 52 to promote isolation of adjacent column electrodes 18. Distance 52 is typically much less than the width of column electrodes 18. The inclinations of the side walls 64 between adjacent plasma channels 20 specify the distance 68, which is typically much less than the width of plasma channels 20. The widths of the column electrodes 18 and the plasma channels 20 are typically the same and are a function of the desired image resolution, which is specified by the display application. It is desirable to make distances 52 and 68 as small as possible. In current models of display panel 12, the channel depth 58 is approximately one-half the channel width.

Each of the plasma channels 20 is filled with an ionizable gaseous mixture, generally a mixture of inert gasses. Layer 46 of dielectric material functions as an isolating barrier between the ionizable gaseous mixture contained within channel 20 and layer 44 of liquid crystal material. The absence of dielectric layer 46 would, however, permit either the liquid crystal material to flow into the channel 20 or the ionizable gaseous mixture to contaminate the liquid crystal material. Dielectric layer 46 may be eliminated from displays that employ a solid or encapsulated electro-optic material.

Figure 4:
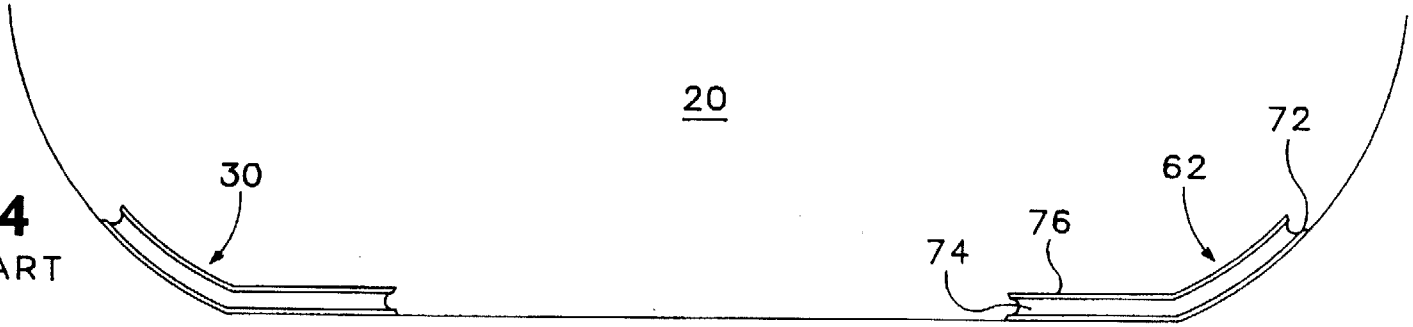
FIG.4 PRIOR ART
FIG. 4 is an enlarged cross-sectional view of a channel in a plasma addressing structure showing the cross-section of a prior art cathode electrode (shown enlarged relative to scale, for clarity of presentation)

FIG. 4 shows in greater detail prior art plasma channel 20 formed in glass substrate 54. Channel 20 is 450 microns wide at the top, 200 microns deep, and approximately 300 microns wide at the bottom. Cathode electrode 62 is about 75 microns wide and has a 0.2 micron thick bottom layer 72 of chromium for good adhesion to glass substrate 54, an approximately 2.0 micron thick layer of copper 74 for good conductance, and a 0.2 micron thick top layer 76 of chromium for sealing the copper layer 74 against oxidation. Skilled persons will appreciate that copper is highly electrically conductive and chromium is electrically conductive and gas impermeable. Anode electrode 30 may have an appearance and structure generally similar to that of cathode electrode 62.

Figure 5:
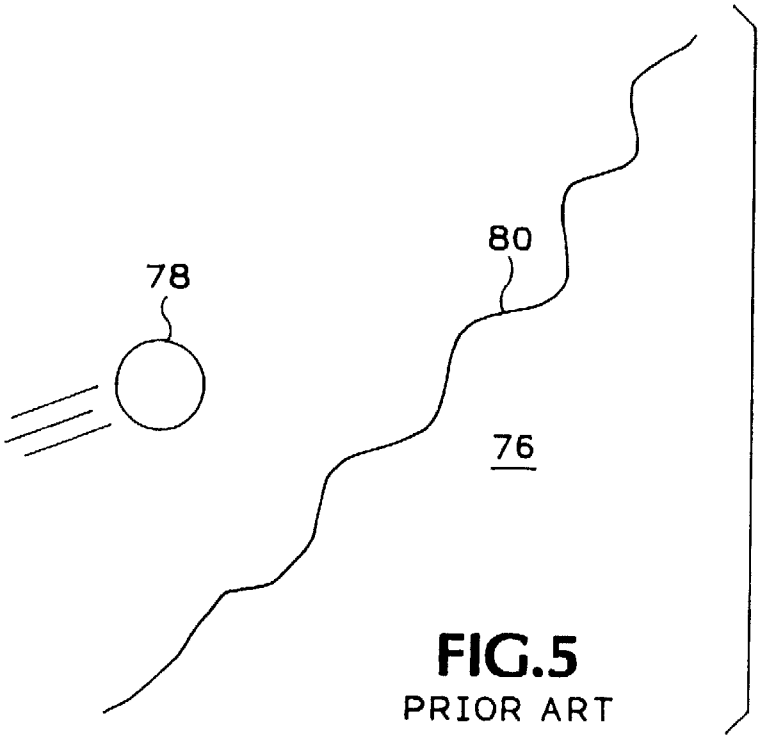
FIG.5 PRIOR ART
FIG. 5 is a greatly magnified cross-sectional view of the surface of the prior art cathode of FIG. 4 with a positive ion propagating toward it.
Figure 6:
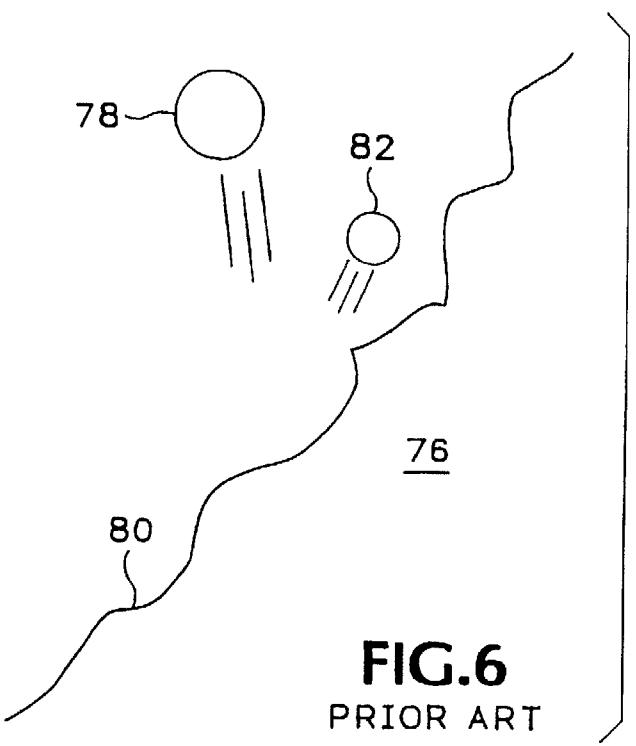
FIG.6 PRIOR ART
FIG. 6 is a greatly magnified cross-sectional view of the surface of the prior art cathode of FIG. 4 after the positive ion has struck it.

FIGS. 5 and 6 show that top chromium layer 76 is susceptible to sputter damage. In FIG. 5, an ion 78 of inert gas is shown propagating toward the wavy surface 80 of top layer 76 of chromium in prior art cathode 62. FIG. 6 shows the results of the collision of ion 78 with surface 80 from which a chromium atom 82 has been dislodged and ion 78 has been deflected. Over time the dislodged chromium atoms 82 become deposited in increasing number on the sides and bottom of channel 20 and on the cover, turning a transmissive display system 10 dark and destroying its usefulness. Further, the chromium deposited on sheet 46 eventually renders its surface sufficiently conductive that it will no longer store different amounts of charge on various pixels 16 so that the lines of the display become uniformly gray.

Figure 7:
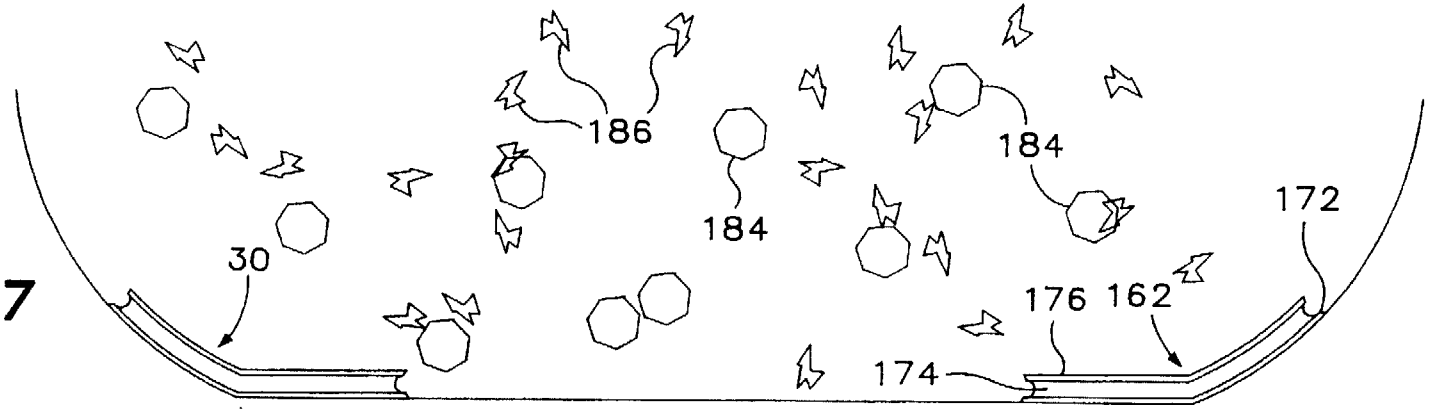
FIG. 7 is a greatly expanded cross-sectional view of a channel in a PALC display undergoing electrophoresis according to the present invention, with the refractory compound and frit particles shown enlarged relative to scale, for clarity of presentation.

FIG. 7 is a cross-sectional view of a plasma channel 120 display undergoing an electrophoresis process conducted according to the present invention. In FIG. 7, like components are labelled with the same reference numerals as those in FIGS. 1–6, except that 100 has been added to each reference numeral. Electrophoresis is a well known technique, and the electrophoresis techniques used in this invention are standard and known to skilled persons.

Positively charged particles 184 of a refractory compound, typically about 4.0 microns in diameter, shown enlarged relative to scale for clarity of presentation, are suspended in a bath of a dielectric liquid such as isopropyl alcohol. Frit particles 186 also positively charged, are shown similarly suspended. A negative potential applied to cathode 162 draws these positively charged particles toward cathode 162. (Typically the same negative potential is applied to all electrodes in the channel during deposition.)

Figure 8:
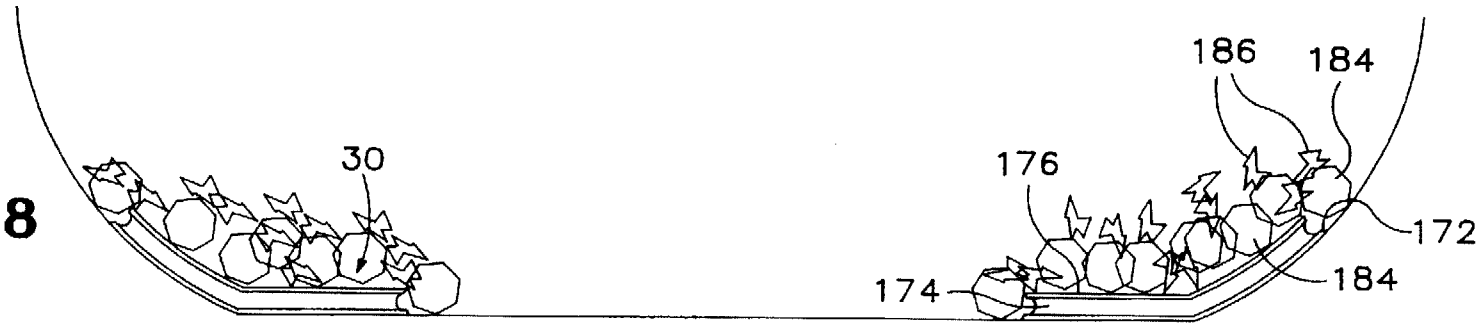
FIG. 8 is a greatly expanded cross-sectional view of the channel and particles of FIG. 7 after the completion of electrophoresis.

FIG. 8 shows a cross-sectional view of the channel of FIG. 7 after the completion of electrophoresis. On top of layer 176 of chromium, a new layer 188 of refractory compound particles 184 is intermixed with frit particles 186. This new layer is approximately 10.0 microns thick. Because top layer 188 of particles is discontinuous and is not air tight, layer 176 of chromium is still used to prevent oxidation of copper layer 174. Layer 176 of chromium extends along the entire length of copper layer 174 and therefore along the entire length of cathode 162.

Figure 9:
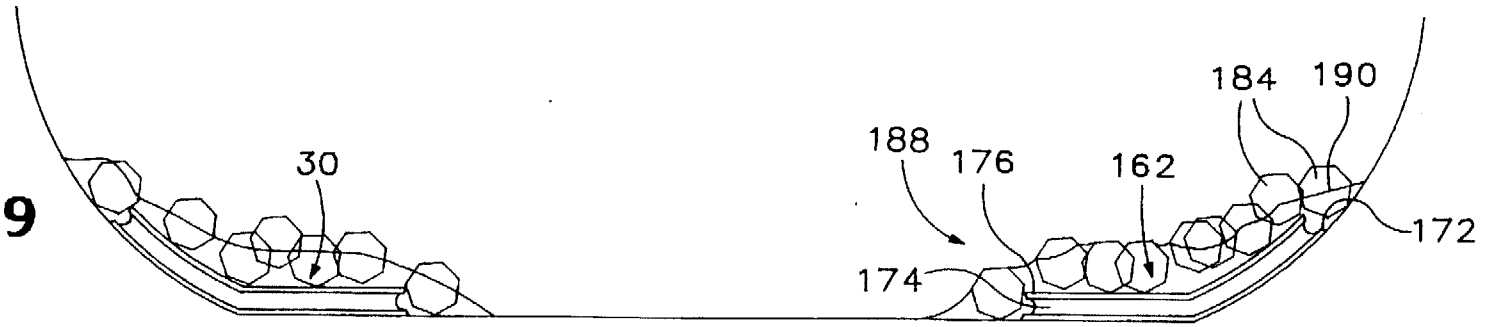
FIG. 9 is a greatly expanded cross-sectional view of the channel and particles of FIG. 7 after a one hour air bake and wherein the frit particles have fused.

FIG. 9 shows a cross-sectional view of the channel of FIG. 7 after the completion of the air bake. The frit particles 186 have fused into a layer of glass 190, thereby cementing the refractory particles 184 to the electrode surface and to each other.

Refractory materials are characterized by high heats of sublimation so that impinging gas ions colliding with them tend not to sublimate or dislodge any molecules of the refractory materials. In addition, the refractory compounds used are chosen for their oxidation resistance during the one hour air bake that is part of the manufacturing process.

Further, the refractory materials used were chosen for their low work functions. The probability of secondary electron emission by either an ionized or an excited gas atom is enhanced when the work function of the refractory material is low. Thus fewer excited or ionized gas atoms are required in order to generate a given quantity of secondary electrons when the work function of the electrode surface is low. Because of these characteristics, it is possible to operate the PALC display with a lower potential gradient applied between its anode and the cathode electrode pairs. Under these operating conditions, a less intense electric field accelerates the ions, thereby leading to lower ion energies and less sputter damage.

Many refractory compounds or combination of refractory compounds will work in the current invention. It is believed, however, that a compound from the group of rare earth hexaborides, particularly $LaB_6$, $YB_6$, $GdB_6$ or $CeB_6$ will provide superior performance compared with most other refractory compounds. Note that for purposes of this application, Yttrium hexaboride ($YB_6$) is counted among the rare earth hexaborides. Although Yttrium is not technically a member of the rare earth group of elements, it shares many of the characteristics of this group. Two other refractory compounds, $Cr_3Si$ and diamond may also provide good performance in this application. The compounds $LaB_6$ and $GdB_6$ have been experimentally verified to perform very well.

To determine the performance of a refractory compound, an experiment may be conducted in which the compound is used in the fabrication of the plasma electrodes of a PALC display and then the display is run to determine the length of operating time necessary to provoke a set level of sputter damage.

It will be obvious to those having skill in the art that many changes may be made to the details of the above-described embodiment of this invention without departing from the underlying principles thereof. The scope of the present invention should, therefore, be determined only by the following claims.

We claim:

1. In an addressing structure for addressing a data element, the addressing structure including an ionizable gaseous medium, a data element that stores a data signal, and cathode and anode electrodes, the addressing structure operating in response to a sufficiently large potential difference applied between the cathode and the anode electrodes to cause the ionizable gaseous medium to transition to a conductive plasma state from a nonionized state and thereby provide an interruptible electrical connection between the data element and an electrical reference to selectively address the data element, a method of forming a cathode electrode structure that during its fabrication is not susceptible to oxidation and that during operation of the addressing structure is resistant to sputter damage and exhibits a high probability of secondary electron emission, comprising:

providing an electrically nonconductive substrate having major surfaces on opposite sides of the substrate and including multiple spaced-apart channels inscribed in one of the major surfaces;

forming lengthwise along each of the multiple channels at least one electrode coated by a protective layer of oxidation resistant material;

depositing on the protective layer of oxidation resistant material a mixture of refractory substance and frit particles as a discontinuous, porous layer having high oxidation resistance, sputter resistance, and secondary electron emission properties that enables the protective layer of oxidation resistant material to function during deposition of the mixture; and fusing the frit particles to form a glass layer that cements the refractory particles together and thereby form a unitary cathode electrode structure having high sputter resistance and high secondary electron emission properties.

2. The method of claim 1 in which the protective layer of oxidation resistant material includes chromium.

3. The method of claim 1 in which the refractory substance particles include at least one of the group of rare earth hexaborides.

4. The method of claim 1 in which the refractory substance particles include $Cr_3Si$ or diamond.

5. The method of claim 1 in which the deposition of the mixture is accomplished by electrophoresis.

6. The method of claim 1 in which the fusing of the frit particles is accomplished by a baking process.

7. The method of claim 1 in which an adhesive interface layer of material is positioned between the electrode and one of the major surfaces.

8. The method of claim 7 in which the adhesive interface layer includes chromium.

9. A plasma addressed liquid crystal display constructed to have at least one cathode electrode structure formed in accordance with the method of claim 1.

10. In an addressing structure for addressing a data element, the addressing structure including an ionizable gaseous medium, a data element that stores a data signal, and cathode and anode electrodes, the addressing structure operating in response to a sufficiently large potential difference applied between the cathode and anode electrodes to cause the ionizable gaseous medium to transition to a conductive plasma state from a nonionized state and thereby provide an interruptible electrical connection between the data element and an electrical reference to selectively address the data element, a sputter resistant cathode electrode structure with high secondary electron emission properties, comprising:

an electrically nonconductive substrate including multiple nonintersecting channels extending in a common direction, each of the multiple channels including a base portion along which an electrode extends lengthwise and has first and second major surfaces, the first major surface being farther from and the second major surface being nearer to the base portion of the channel; and a coating including a fused mixture of particles of a refractory substance and frit covering the electrode in each of the multiple channels to form a unitary cathode electrode structure, the refractory substance providing the electrode with high sputter resistance and high secondary electron emission properties, and the frit cementing the particles of refractory substance together and to the first major surface of the electrode.

11. The cathode electrode structure of claim 10 in which for each of the multiple channels, a gas impermeable protective layer is interposed between the coating and the first major surface of the electrode.

12. The cathode electrode structure of claim 11 in which the gas impermeable protective layer includes chromium.

13. The cathode electrode structure of claim 10 in which for each of the multiple channels an adhesive interface layer is positioned between the second major surface of the electrode and the base portion of the channel.

14. The cathode electrode structure of claim 13 in which the adhesive interface layer includes chromium.

15. The cathode electrode structure of claim 10 in which the refractory substance particles include at least one of the group of hexaborides.

16. The cathode electrode structure of claim 10 in which the refractory substance particles include $Cr_3Si$ or diamond.

* * * * *